US006681669B1

(12) United States Patent
Bogan

(10) Patent No.: US 6,681,669 B1
(45) Date of Patent: Jan. 27, 2004

(54) METHOD AND APPARATUS FOR CUTTING A COMPRESSIBLE MATERIAL HAVING AN UNCOMPRESSED THICKNESS GREATER THAN A RADIUS OF A WHEEL CUTTER

(75) Inventor: Christopher C. Bogan, Charlestown, MA (US)

(73) Assignee: Gerber Technology, Inc., Tolland, CT (US)

( * ) Notice: Subject to any disclaimer, the term of this patent is extended or adjusted under 35 U.S.C. 154(b) by 0 days.

(21) Appl. No.: 09/326,822

(22) Filed: Jun. 7, 1999

(51) Int. Cl.[7] ..... B26D 1/18
(52) U.S. Cl. ..... 83/176; 83/19; 83/940
(58) Field of Search ..... 83/19, 176, 940, 83/578, 939, 941, 614, 453, 454, 455; 30/292

(56) References Cited

U.S. PATENT DOCUMENTS

| | | | | | |
|---|---|---|---|---|---|
| 178,273 | A | * | 6/1876 | Coburn | 30/292 |
| 3,548,699 | A | * | 12/1970 | Gerber et al. | 83/528 |
| 3,690,203 | A | * | 9/1972 | Huttemann | 83/176 |
| 3,693,489 | A | * | 9/1972 | Pearl | 83/374 |
| 3,777,604 | A | * | 12/1973 | Gerber | 83/374 |
| 3,841,187 | A | * | 10/1974 | Gerber et al. | 83/451 |
| 3,855,887 | A | * | 12/1974 | Pearl et al. | 83/49 |
| 3,971,277 | A | * | 7/1976 | Kowalski et al. | 83/176 |
| 3,982,845 | A | * | 9/1976 | Dockery et al. | 408/1 R |
| 4,062,116 | A | * | 12/1977 | Arnott | 30/292 |
| 4,078,463 | A | | 3/1978 | Leonard et al. | |
| 4,304,512 | A | * | 12/1981 | Vierstraete | 409/80 |
| 4,362,077 | A | * | 12/1982 | Gerber | 83/453 |
| 4,383,458 | A | * | 5/1983 | Kitai et al. | 83/405 |
| 4,401,001 | A | * | 8/1983 | Gerber et al. | 83/451 |
| 4,601,594 | A | * | 7/1986 | Hayashi et al. | 400/196.1 |
| 4,643,061 | A | * | 2/1987 | Gerber | 83/174.1 |
| 4,685,363 | A | * | 8/1987 | Gerber | 83/22 |
| 5,046,392 | A | | 9/1991 | Keon et al. | |
| 6,308,602 | B1 | * | 10/2001 | Gerber | 83/76.6 |

FOREIGN PATENT DOCUMENTS

| | | | |
|---|---|---|---|
| GB | 2190930 | * | 12/1987 |

* cited by examiner

*Primary Examiner*—Kenneth E. Peterson
(74) *Attorney, Agent, or Firm*—McCormick, Paulding & Huber LLP

(57) ABSTRACT

A wheel cutter for cutting a compressible material having a relaxed thickness greater than a radius of the wheel cutter is disclosed, wherein a compressor guide locally compresses the batting to a thickness less than a radius of the wheel cutter. In one configuration, the compressor guide includes a compressor wheel eccentrically mounted with respect to the wheel cutter.

5 Claims, 6 Drawing Sheets

METHOD AND APPARATUS FOR CUTTING A COMPRESSIBLE MATERIAL HAVING AN UNCOMPRESSED THICKNESS GREATER THAN A RADIUS OF A WHEEL CUTTER

FIELD OF THE INVENTION

The present invention relates to cutting compressible material such as batting, and more particularly, to a wheel cutter for cutting, wherein the batting has a relaxed thickness greater than a radius of a cutting wheel. The present invention contemplates locally compressing the batting in the area of the cutting by the wheel cutter.

BACKGROUND OF THE INVENTION

Many insulated garments, sleeping bags, footwear and the like are filled with down while others use as insulating materials such things as cotton batting, kapok, various synthetic fibers and the like. These insulating materials are often manufactured or sold in the form of thick compressible sheets or mats which must be precut to a particular size and shape before being sewn or otherwise fastened between the two layers of fabric which will ultimately cover same, both inside and out.

Polyester fiberfill filling material (sometimes referred to as polyester fiberfill) has become well accepted as a reasonably inexpensive filling and/or insulating material especially for pillows, and also for cushions and other furnishing materials, including other bedding materials, such as sleeping bags, mattress pads, quilts and comforters and including duvets, and in apparel, such as parkas and other insulated articles of apparel, because of its bulk filling power, aesthetic qualities and various advantages over other filling materials, and is now manufactured and used in large quantities commercially.

The filled articles include articles of apparel, such as parkas and other insulated or insulating articles of apparel, pillows, bedding materials (sometimes referred to as sleep products) other than pillows, including mattress pads, comforters and quilts including duvets, and sleeping bags and other filled articles suitable for camping purposes, for example, furnishing articles, such as cushions, "throw pillows" (which are not necessarily intended for use as bedding materials), and filled furniture itself, toys and, indeed, any articles that can be filled with a batting such as polyester fiberfill. While these items may employ additional filling material they rely in part upon the batting.

In addition to these insulating materials, various foams are often used as cushioning, wherein the foam is manufactured in slabs which must be cut prior to use.

Cutting these thick compressible mats, especially more than one at a time, poses certain problems that do not admit to an easy solution. Standard self-contained electric powered fabric cutting tools are generally unable to effectively cut a single sheet or a stack of such compressible material because, ordinarily, the means used to hold the pattern down tightly against the sheet or stack interferes with the movement of the cutting tool.

Another problem in such an operation is the inordinately long set-up time usually required to arrange and fasten down the patterns for cutting different shaped pieces. It is not uncommon, for example, to cut enough pieces to make, say a dozen to a hundred finished articles in a single operation taking, perhaps, only a few minutes. At this rate, a sizable inventory can be built up in a short period of time on a given item and, therefore, it becomes necessary to change the set up so that a different size of the same article or a different one altogether can be cut. It is not uncommon to find that the set-up time required to change over to a different product or even a different size in the same product exceeds the cutting time.

Prior systems often employ a vacuum table to retain the batting. However, as the batting does not create a sufficient pressure differential, a plastic (air impervious) sheet is disposed over the batting. The vacuum draws the plastic sheet down, thereby compressing the batting and allowing the material to be cut. This procedure requires extra time in disposing the plastic sheet over the batting prior to cutting. In addition, the plastic sheet is sacrificial and adds cost to the process. Once a plastic sheet is used it must be thrown out or recycled.

Therefore, the need exists for an apparatus for efficiently cutting batting. A need also exists for cutting the batting without requiring extensive layout or hold down procedures. The need also exists for an apparatus that accommodates a relatively large variance in batting thickness, as well as allows for ready configuration to accommodate substantially different batting thickness.

SUMMARY OF THE INVENTION

The present invention provides a method and apparatus for cutting batting with a wheel cutter, and particularly, with a wheel cutter having a radius which is less than the thickness of uncompressed batting.

Generally, the present invention provides a cutting assembly having a support surface for supporting a portion of the batting to be cut. The cutter assembly is carried by a carriage to be moveable with respect to the support surface and engage a wheel cutter with the support surface. The wheel cutter has a radius which is less than the thickness of the batting and is generally substantially less than the thickness of the batting.

The carriage assembly includes a compressor guide adjacent the wheel cutter for movement with the wheel cutter and locally compressing the batting to a thickness less than a radius of the wheel cutter. In an advantageous configuration, the compressor guide is adjustable with respect to its spacing from the support surface. Thus, the cutting assembly may cut any of a variety of batting thicknesses or a varying batting thickness. Preferably, the compressor guide is a compressor wheel rotatably mounted to the carriage and non-concentric with the wheel cutter. In one configuration, the compressor guide includes a pair of compressor wheels rotatably mounted to the carriage to locate the wheel cutter therebetween.

In use, the present invention compresses the batting in front of the leading edge of the wheel cutter to a thickness less than radius of the wheel cutter such that upon passage of the wheel cutter, the batting has a thickness less than the radius of the wheel cutter and the wheel cutter can effectively severe the compressed batting.

DETAILED DESCRIPTION OF THE PREFERRED EMBODIMENT

The present invention provides an apparatus and method for cutting a compressible material such as batting 8. In particular, the batting 8 includes but is not limited to insulating materials such as kapok, glasswool, synthetic fibers and the like including thick compressible sheets of insulation, as well as foam, typically employed as cushioning. Batting 8 is generally resiliently compressible and includes a relatively large void to material percentage in an uncompressed state. The term "batting" is taken as a compressible material, that has a relaxed thickness (state) and may be non-destructively compressed to a compressed state, and subsequently return to the relaxed thickness. The batting 8, typically assumes its relaxed, uncompressed thickness upon being freed from a roll or packing.

Figure 1:
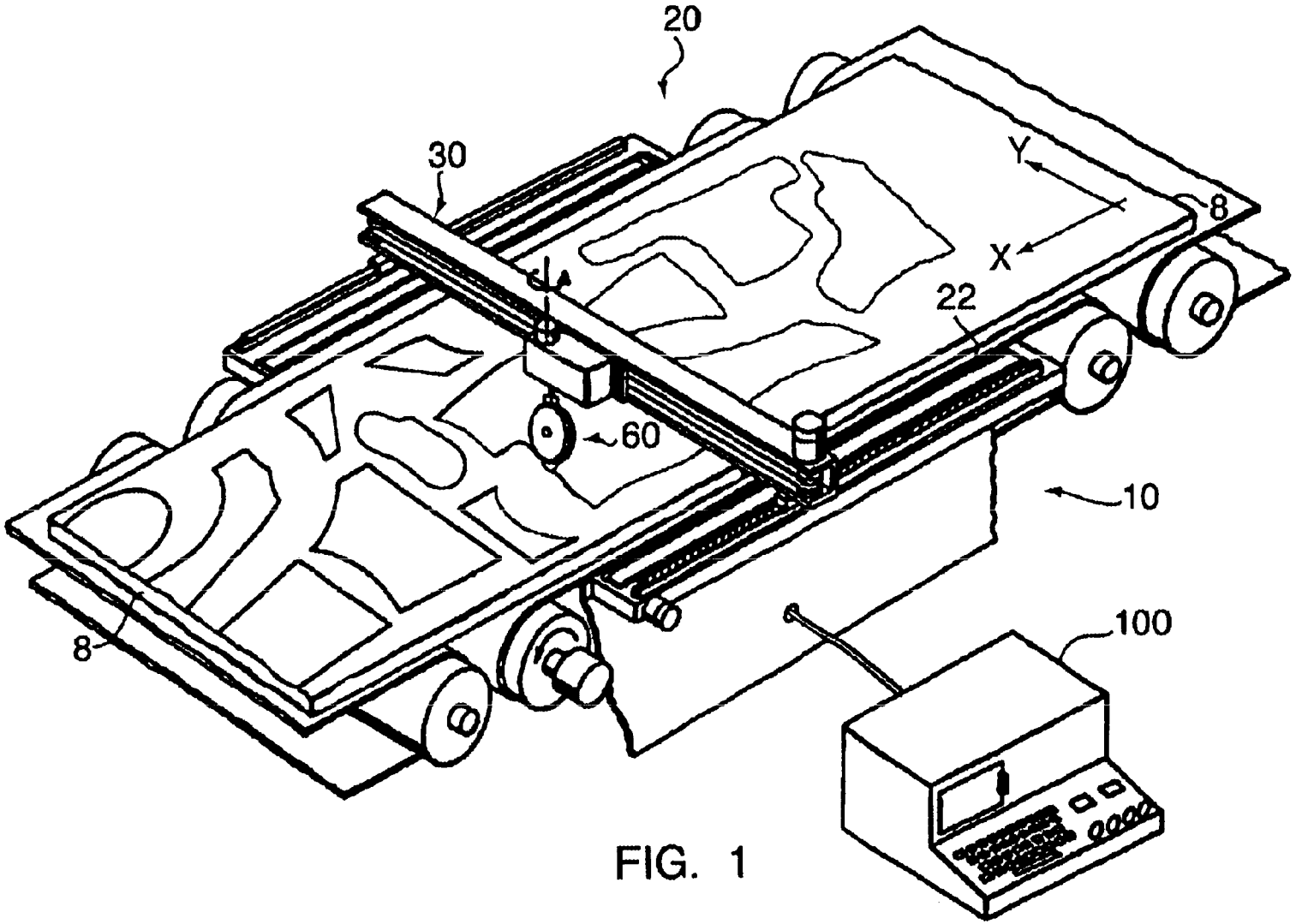
FIG. 1 is a perspective view of a cutting system.

Referring to FIG. 1, the present invention may be employed in an automated cutting station 10 for cutting the batting 8. Generally, the cutting station 10 includes a table assembly 20, a carriage assembly 30, a cutter assembly 60 and a controller 100.

Table Assembly

Referring to FIG. 1, the table assembly 20 provides a support surface 22 for retaining the batting 8 to be cut. Although the support surface 22 is shown as a generally planar horizontal member, it is understood the support surface may be inclined, curvilinear or even drum shaped and does not limit the invention.

In addition, the support surface 22 may be resilient or slightly penetrable material such as a plastic or sacrificial materials. Alternatively, the support surface 22 may be a belt which is selectively translatable so as to transport the batting 8. Further, the support surface 22 may be cooperate with a vacuum system to provide vacuum retention of the batting 8. A useful support surface 22 includes a multitude of projecting fibers that releasably engage the batting 7 and sufficiently retain the batting relative to the support surface. The projecting fibers and batting 8 thus function as a hook and loop type fastener.

Carriage Assembly

Figure 2:
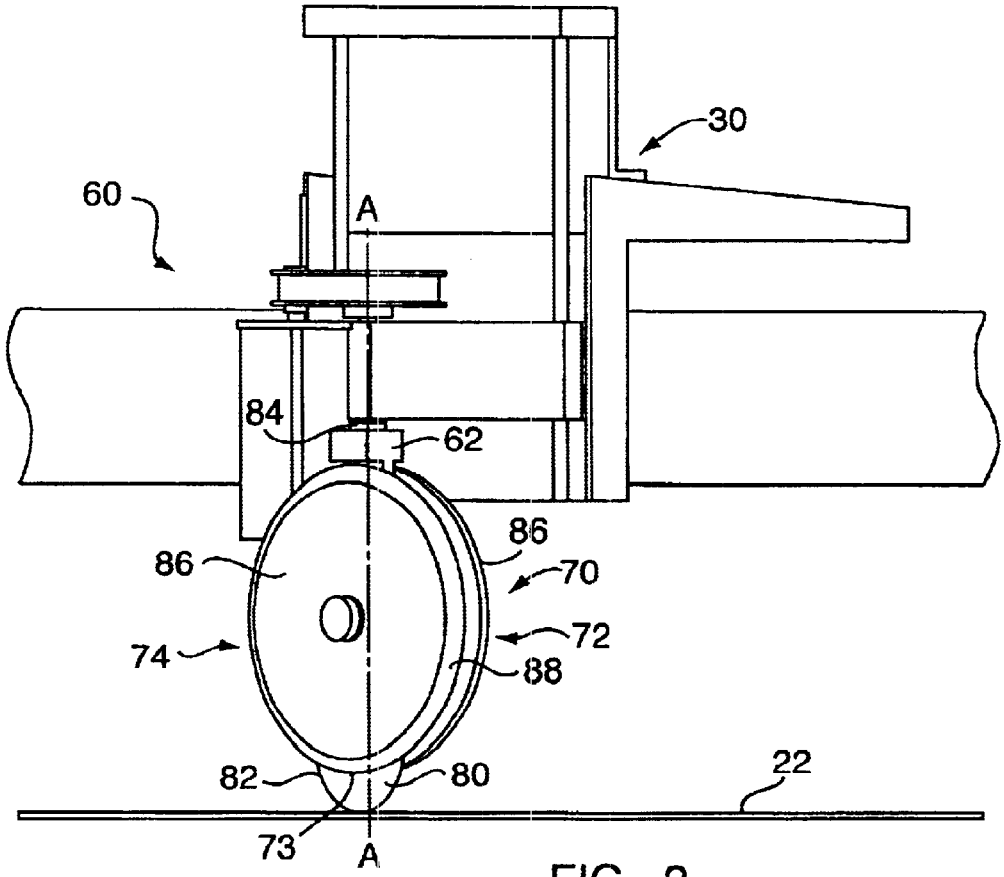
FIG. 2 is a perspective view of the carriage and cutter assembly.
Figure 5:
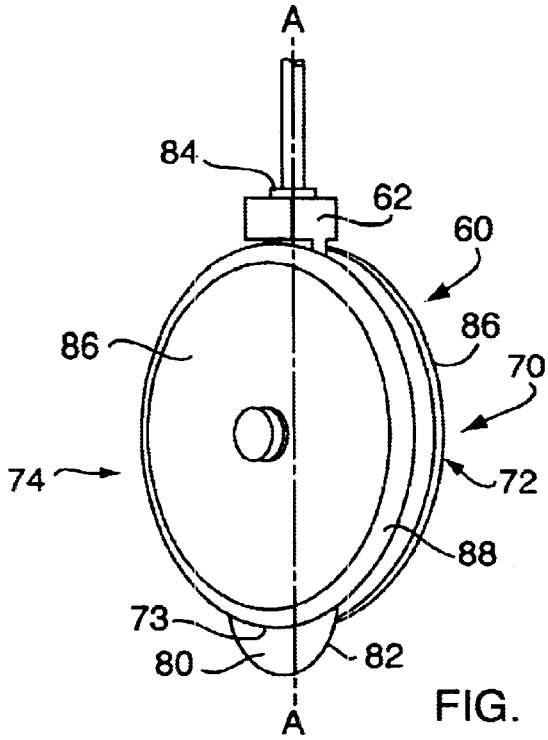
FIG. 5 is a perspective view of the compressor wheel and wheel cutter configuration.
Figure 4:
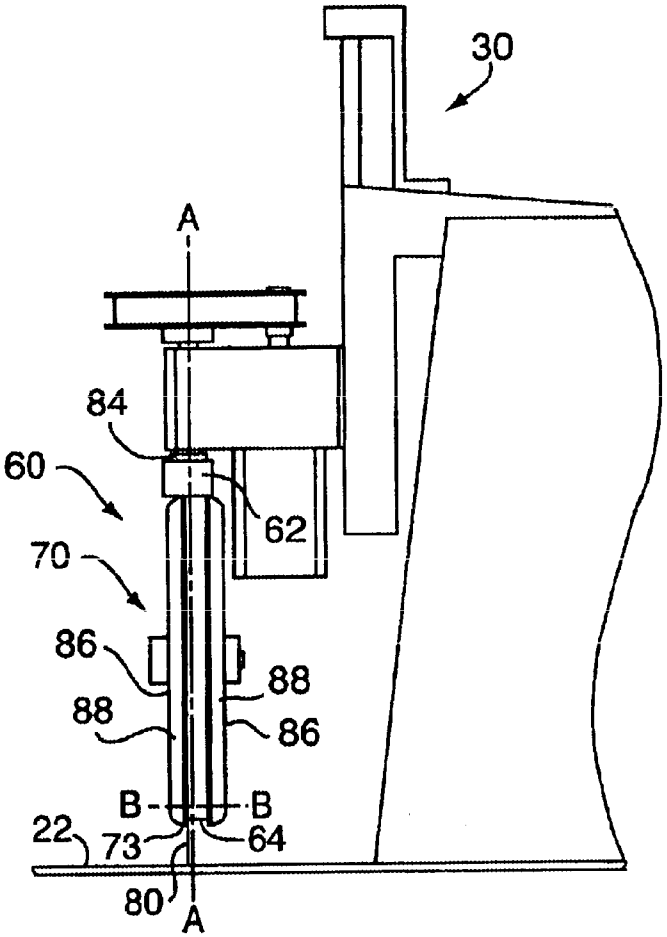
FIG. 4 is a front elevational view of the cutter assembly.
Figure 3:
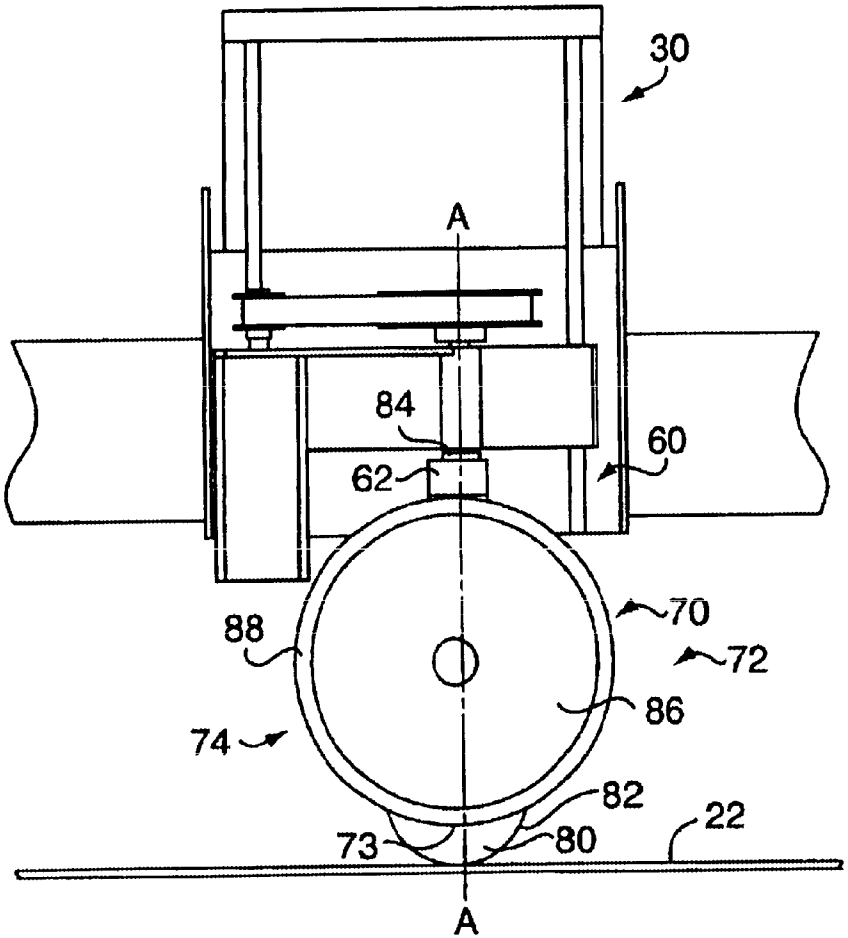
FIG. 3 is side elevational view of the cutter assembly.
Figure 7:
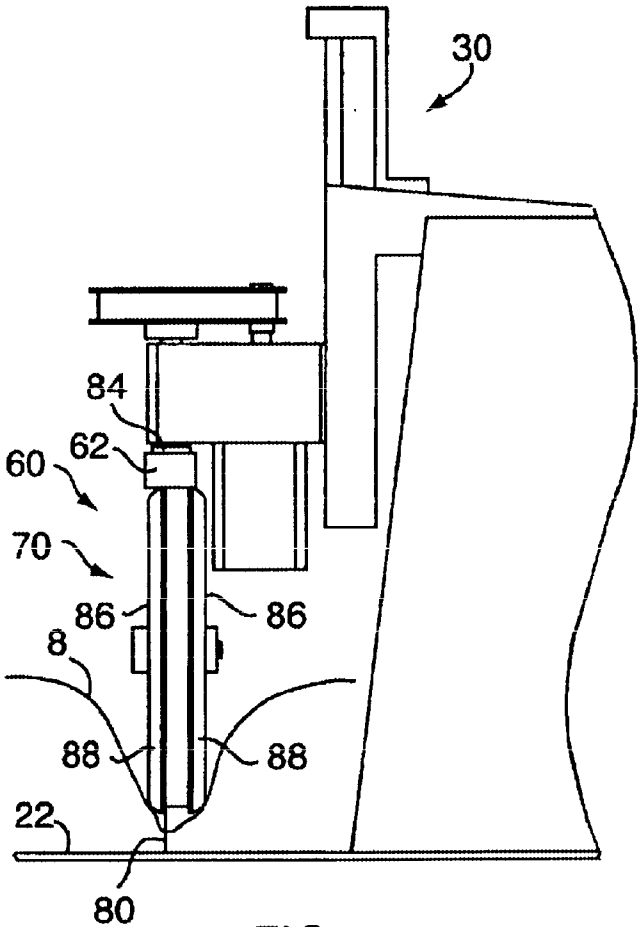
FIG. 7 is a front elevation al view of the compressor wheel configuration showing compression of the batting.
Figure 6:
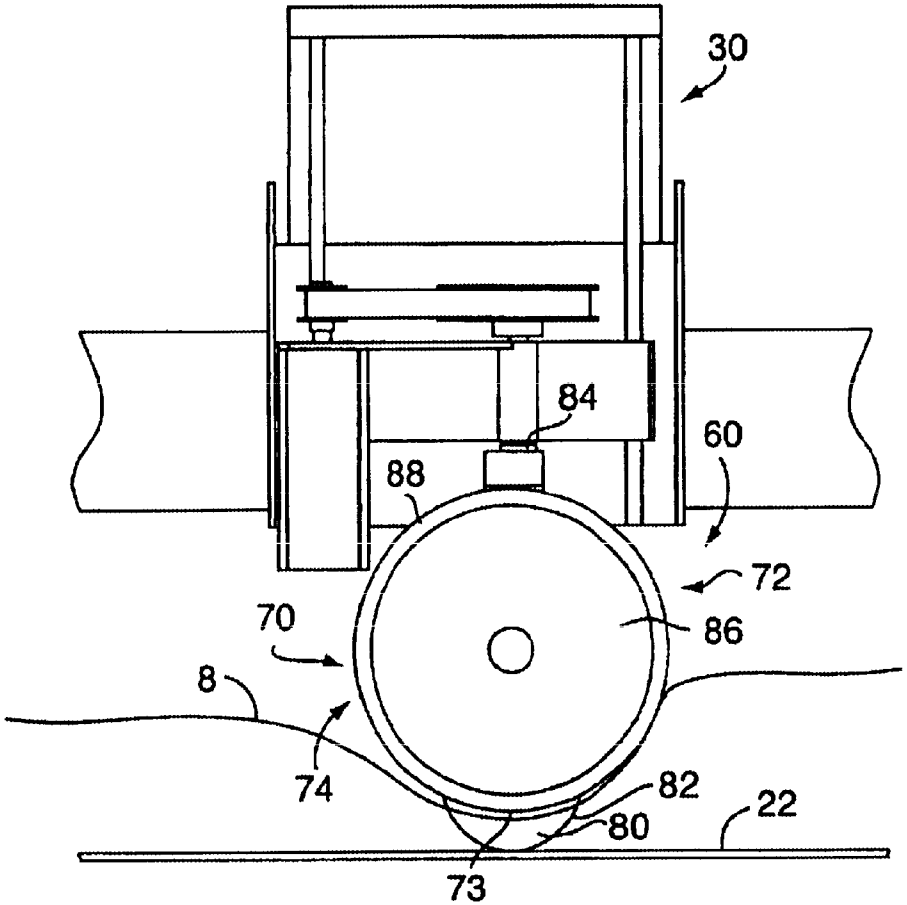
FIG. 6 is a side elevational view of the compressor wheel configuration showing compression of the batting.

The carriage assembly 30 is generally supported relative to the table assembly 20 to moves the cutter assembly 60 in a longitudinal and transverse coordinate direction relative to the support surface 22 in response to signals from the controller 100, in a manner well known in the art. As shown in FIGS. 2–4, the cutter assembly 60 is connected to the carriage assembly 30 for angular movement about a generally vertical pivot axis A—A in response to signals from the controller 100. The carriage assembly 30 includes a plunger or throw mechanism such as a hydraulic or pneumatic piston, cam, motor or spring for urging the cutter assembly 60 towards the support surface 22.

The plunger mechanism provides sufficient vertical displacement of the cutter assembly 60 to permit the loading, cutting and unloading of the batting 8 from the support surface 22. The cutter assembly 60 is movable between a load position and a cut position. In the load position, the batting 8 may be readily located between the support surface 22 and the cutter assembly 60. In the cut position, the cutter assembly 60 is located to cooperate with the support surface 22 to locally severe the batting 8. Thus, the carriage assembly 30, the cutter assembly 60 or the combination, provides sufficient vertical throw to be movable between the load and the cut position.

Cutter Assembly

As shown in FIGS. 2–5, the cutter assembly 60 is mounted to the carriage assembly 30 so that the cutter assembly can be rotated about the pivot axis A—A. The cutter assembly 60 includes a strut 62, a compressor guide 70 and a wheel cutter 80.

The strut 62 is connected to the carriage assembly 30 and is sized to retain the wheel cutter 80 and the compressor guide 70. The strut 62 terminates at a lower end 64 and is rotatable about the pivot axis A—A and moveable for vertical displacement with respect to the support surface 22. The strut 62 may have any of a variety of configurations, but is shown as a generally vertically oriented bar. The strut 62 has sufficient rigidity to substantially preclude deflection or deformation under operating parameters of the system.

The wheel cutter 80 is rotatably connected to the strut 62 adjacent the lower end 64 of the strut. The wheel cutter 80 has an axis of rotation B—B. The periphery of the wheel cutter 80 extends beyond the lower end 64 of the strut 62. The wheel cutter 80 includes a peripheral cutting edge for locally contacting and severing the batting 8.

The peripheral cutting edge circumscribes the axis of rotation B—B in a plane normal to the axis B—B. The axis of rotation B—B of the wheel cutter 80 may be rotated about the pivot axis A—A so that the wheel cutter 80 tracks against the support surface 22 in any direction within the plane of the support surface.

In addition, pivot axis A—A is non intersectingly aligned with the axis of rotation B—B. That is, the axis of rotation B—B is offset from the axis of rotation A—A, so that during cutting engagement with the support surface 22, the pivot axis A—A leads the translation of the axis of rotation B—B as the wheel cutter 80 traverses a cut path along the support surface.

The wheel cutter 80 typically has a diameter of approximately 2 inches to approximately 2 ½ inches. Such wheel cutters are commercially available products and have a proven life cycle. However, for larger diameter wheel cutters, the useful life is substantially shorter and performance is also compromised. Thus, there is a substantial incentive to employ the relatively inexpensive, proven and predictable wheel cutters of approximately 2.5 inch diameter or less.

The compressor guide 70 is connected to the strut 62 and includes a leading face 72 and compressing face 74. The leading face 72 is spaced from the wheel cutter 80 to be located in front of the wheel cutter upon the batting 8 being cut. The leading face 72 is also spaced from the support surface 22 by a distance at least equal to the initial or relaxed thickness of the batting 8. Preferably, the leading face 72 is generally inclined with respect to the support surface 22 and extends from a height at least equal to the thickness of the relaxed batting 8 to a reduced height.

The compressing face 74 generally extends from the leading face 72 to a nadir 73 adjacent the wheel cutter 80. The compressing face 74 reduces the thickness of the batting 8 from an initial thickness to a compressed thickness generally equal to the distance from the nadir 73 to the support surface 22 when the wheel cutter 80 engages the support surface 22. In one configuration, the nadir 73 of the compressing face 74 is spaced from the support surface 22 by a distance less than the diameter of the wheel cutter 80 and preferably less than the radius of the wheel cutter. Although the leading face 72 and the compressing face 74 are shown as continuous, it is contemplated there may be a discontinuity between the leading face and the compressing face. Preferably, the discontinuity does not inhibit motion of the batting 8 relative to the compressor guide 70.

Figure 10:
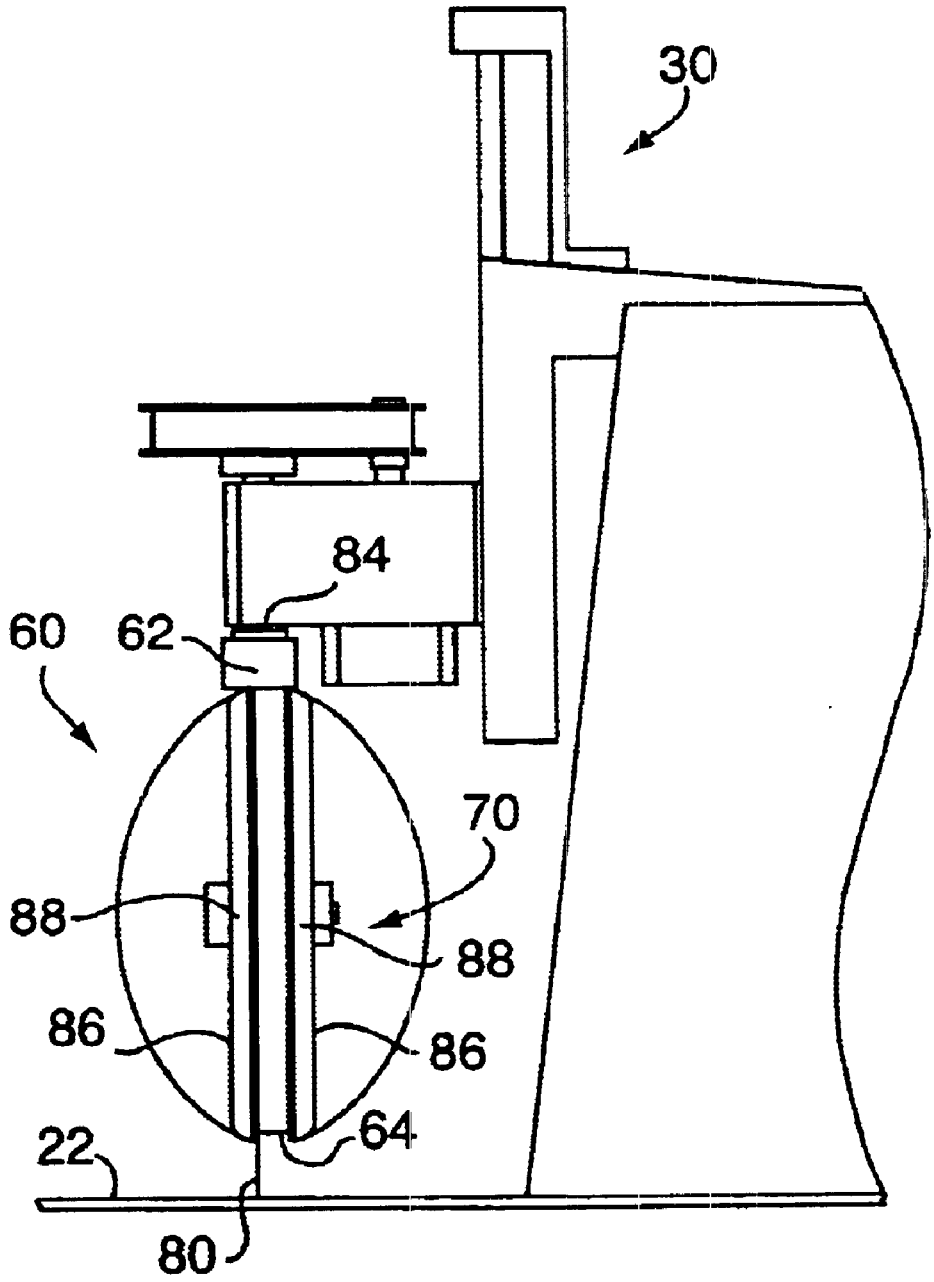
FIG. 10 is a front elevational view of a compressor wheel.

It is also contemplated that the compressor guide 70 may include a projecting surface extending parallel to the axis of rotation B—B. The projecting surface is shown in FIG. 10 and is sized to assist the cutter assembly 60 in curvilinear cut paths as well as forming intersecting cut paths.

The compressor guide 70 may be connected to the strut 62 at any of a number of vertical positions, thereby accommodating a variety of batting 8 thicknesses. The compressor guide 70 may be connected to the strut 62, or carriage assembly 30, by a floating connection 84 to permit the compressor guide to float with respect to the support surface 22. That is, the compressor guide 70 moves towards and away from the support surface 22 as the wheel cutter 80 follows a cut path.

The floating connection 84 thus allows the spacing between the compressor guide 70 and the support surface 22 to vary while the batting 8 is being cut. The floating connection 84 includes a track in the strut 62 along which a pin connected to the compressor guide 70 may slide. A spring extends between the strut 62 and the compressor guide 70 to urge the compressor guide towards the support surface 22. Thus, thicker batting 8 will be subjected to a greater compressive force by the compressing face 74 and thinner batting will encounter a reduced compressive force. The particular characteristics of the spring may be selected in response to the anticipated batting 8 to be cut.

Alternatively, the floating connection 84 may be a hydraulic or pneumatic piston extending between the strut 62 and the compressor guide 70, wherein a pressure sensor is employed to provide feedback to the controller 100 for maintaining or altering the force exerted by the compressor guide.

It is contemplated the floating connection 84 may be connected to different portions of the compressor guide 70 so that the spacing of the leading face 72 may changed relative to the compressing face 74, or both faces may be moved relative to the support surface 22.

Figure 9:
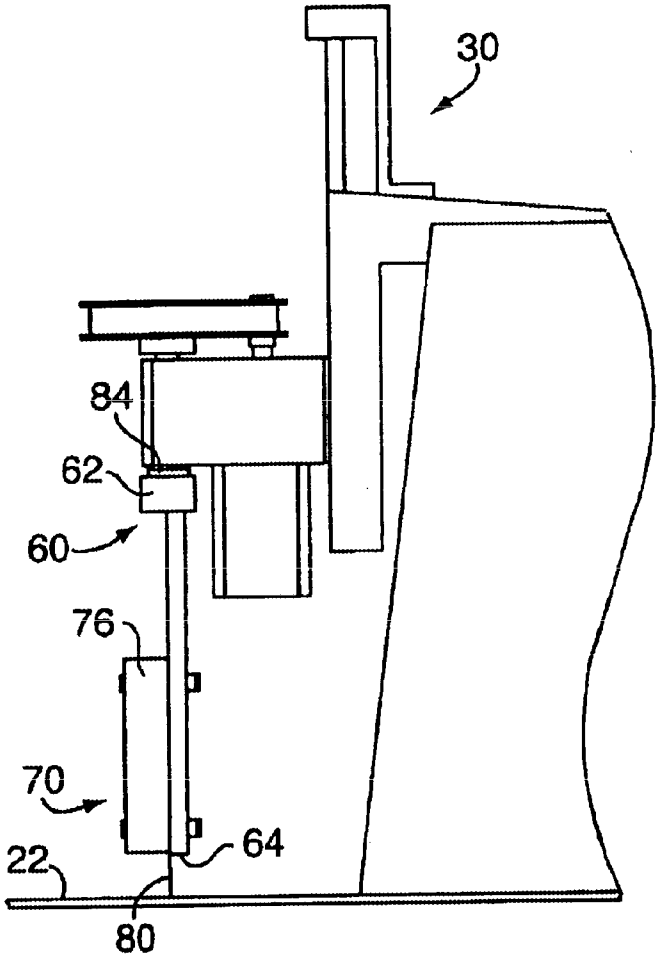
FIG. 9 is a front elevation al view of the belt configuration of FIG. 8 showing compression of the batting.
Figure 8:
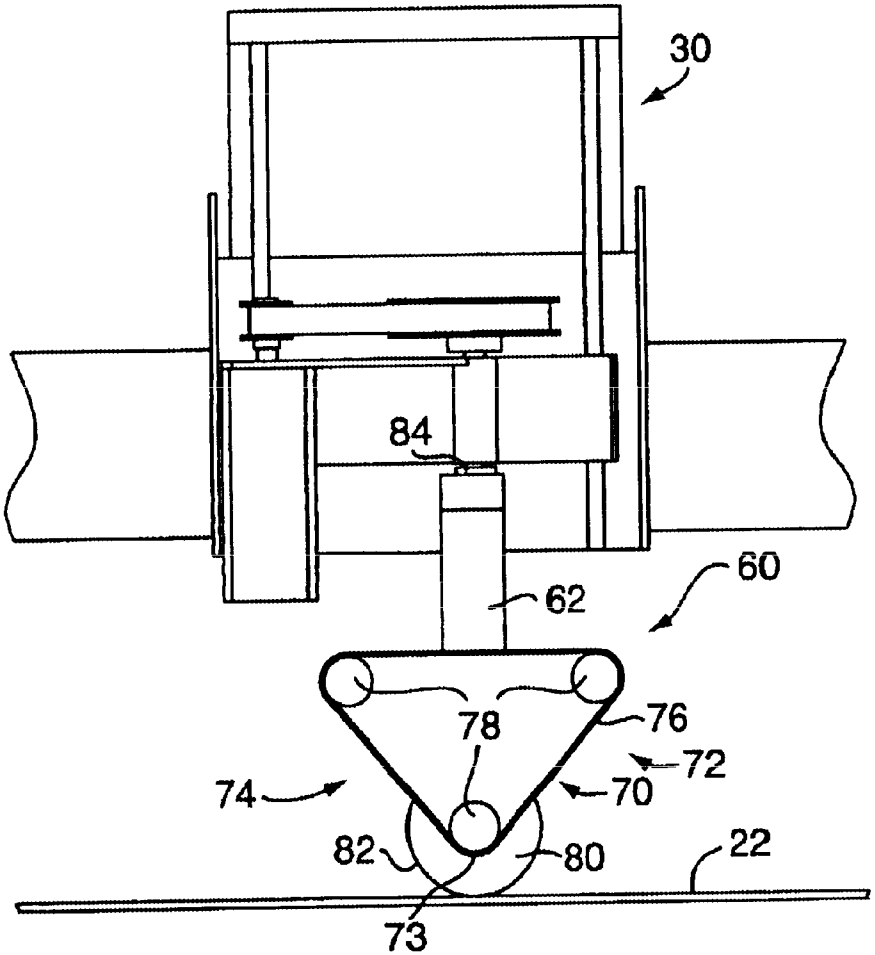
FIG. 8 is a side elevational view of a belt configuration showing compression of the batting.

The compressor guide 70 may be any of a variety of configurations. For example, as shown in FIGS. 8 and 9, a belt 76, tread, chain, flexible web or mail ("belt") may be used as the compressor guide 70. In the belt 76 configuration, the belt is rotated about a path that forms a leading face 72 and a compressing face 74. The path may be circular, oval, triangular or any other shape that provides the functions of the compressor guide 70. The belt 76 path may be formed by a plurality of rollers 78. The rollers 78 may be uniformly sized or of varying sizes, as dictated by the desired belt 76 path. Depending upon the batting 8 to be cut, the belt 76 may have any of a variety of widths. The belt 76 path may be selected to locate the leading face 72 at a predetermined distance from the wheel cutter 80. Similarly, the compressing face 74 may be set at any relation to the wheel cutter 80.

In a preferred configuration, the compressor guide 70 is a compressor wheel 86 rotatably mounted to the strut 62 about an axis of rotation. The compressor wheel 86 provides the leading surface and the compressing surface. These surfaces are formed by different portions of the compressor wheel 86 and are continuous.

The compressor wheel 86 and the wheel cutter 80 are eccentrically mounted to the strut 62. That is, the axis of the rotation of the wheel cutter 80 and the axis of rotation of the compressor wheel 86 are not coincident. In a first configuration, the compressor wheel 86 axis of rotation is vertically displaced from the wheel cutter 80 axis of rotation. The amount of displacement is at least partially determined by the thickness of the batting 8 to be cut, the diameter of the wheel cutter 80 and the diameter of the compressor wheel 86.

The sizing of the compressor guide 70 (compressor wheel 86) is at least in part set by the thickness of the batting 8 to be cut. Generally, the batting 8 is compressible to a thickness that is no greater than the radius of the wheel cutter 80. In the compressor wheel 86 configuration, the compressor wheel is sized to a diameter that the combined radius of the compressor wheel and the wheel cutter 80 are at least slightly greater than the relaxed thickness of the batting 8.

Generally, the compressor wheel 86 is vertically offset from the wheel cutter 80 such that the radius of the compressor wheel encompasses the axis of rotation of the wheel cutter, and the axis of rotation of the compressor wheel is spaced from the support surface 22 to be slightly above the uncompressed thickness of the batting 8. The radius of the compressor wheel 86 is preferably such that the axis of rotation of the compressor wheel is located no closer to the support surface 22 than the uncompressed thickness of the batting 8.

That is, the combined height of the wheel cutter 80 radius and the compressor wheel 86 radius is at least substantially equal to the thickness of the batting 8 to be cut. It is understood the height of the wheel cutter 80 radius and the compressor wheel radius may be substantially greater than the thickness of the batting 8.

Although the compressor wheel 86 is shown as mounted to a single location to the strut 62, it is contemplated that the compressor wheel may be located at any of a plurality of locations along the strut to vertically offset the compressor wheel from the support surface 22. That is, the compressor wheel 86 may be mounted at a plurality of locations along the strut 62 to locate the periphery of the compressor wheel at a variety of elevations with respect to the support surface 22, thereby accommodating a variety of batting 8 thicknesses as well as allowing use of a variety of compressor wheel sizes. Thus, different size compressor wheels may be readily employed.

As shown in FIG. 3, the compressor wheel 86 has a generally rounded peripheral flange 88. Unlike the wheel cutter 80 that has a sharp peripheral edge 82, the compressor wheel 86 has a wide flattened periphery. The radiused peripheral flange 88 reduces snagging or engaging with the batting 8, while still providing a sufficient compressive force to compress the batting to less than the radius of the wheel cutter 80. An outer surface of the compressor wheel 86, the portion that contacts the batting 8, may include a surface texture such as knurling or a resilient contact layer such as a thermoplastic or thermosetting material to induce rotation of the compressor wheel as the batting moves relative to the compressor wheel.

The peripheral flange 88 of the compressor wheel 86 is preferably located sufficiently near the wheel cutter 80 to preclude expansion or migration of the batting 8 adjacent the wheel cutter. That is, the distance between the compressing face 74 and the wheel cutter 80 is less than the distance required for the batting 8 to assume its relaxed thickness. It is understood the batting 8 may be "overly" compressed by the compressor wheel 86 and slightly relax across the distance between the compressing wheel and the wheel cutter 80 to a greater thickness, which is still less than the radius of the wheel cutter.

The compressor wheel 86 may be freely rotatable with respect to the strut 62. Alternatively, the compressor wheel 86 may be driven so as to assist in translation of the batting 8 relative to the wheel cutter 80. However, it is anticipated that free rotation will adequately compress the batting 8 and reduce the complexity and cost of the system. In either configuration, the peripheral flange 88 of the compressor wheel 86 may be formed with or without the surface texture or a resilient contact layer.

Although, the compressor wheel 86 may be formed of a variety of materials, it has been found desirable to form the compressor wheel of as light a material as possible to reduce wear and power requirements on the cutter assembly 60 and the carriage assembly 30. Therefore, the compressor is formed of rigid plastic such as a thermoplastic. However, composites, metals or other plastics may be used without limiting the invention.

As shown in FIGS. 2–7, the present configuration includes a first and a second compressor wheel 86 adjacent the wheel cutter 80, wherein the largest radius of the peripheral flange 88 of each compressor wheel is adjacent the wheel cutter.

It is also contemplated the compressor guide 70 and the wheel cutter 80 may be connected to separate struts, so that the wheel cutter may be lifted from cutting engagement with the support surface 22 while maintaining the locally compressed batting 8. The wheel cutter 80 could then be rotated and re-engaged with the batting 8 without requiring movement of the compressor guide 70.

Controller

The controller 100 is a standard desktop computer such as an IBM, compatible or Macintosh. The controller 100 includes a user interface for entering instructions as to the batting 8 and patterns to be cut.

A cutting program runs in the controller 100 for directing the orientation of the cutter assembly 60 relative to the desired periphery. The cutting program may designate the desired cut path. The cutting program includes instructions for directing the wheel cutter 80 along the desired cut path and maintains the axis of rotation perpendicular to any radius of curvature in the cut path. In order for sufficient borders or tolerances to exist, a nesting program may adjust a nest of the parts to be cut.

Operation

In operation, the batting 8 is disposed upon the support surface 22 and may be retained by application of a vacuum, releasable adhesive, mechanical clamps or other chemical bonding. It has been found advantageous to employ a support surface 22 having the projecting fibers for engaging the batting 8.

The cutter assembly 60 is brought from its load position to its cut position, wherein the wheel cutter 80 is urged against the support surface 22 and the compressor wheel 86 locally compresses the batting 8 in the region of the wheel cutter. The relative compression of the batting 8 is shown in FIGS. 8 and 9.

As the cutter assembly 60 moves along a cut path, the leading face 72 of the compressor guide 70 (leading portion of the compressor wheel) engages the batting 8 and urges the batting 8 toward the support surface 22 thereby locally compressing the batting. As the cutter assembly 60 further progresses, the batting 8 contacts the leading face 72 and then the compressing face 74 and the batting is further compressed. In the compressor wheel 86 configuration, the compressor wheel continues to compress the batting 8 as the compressor wheel rotates. Thus, as the batting 8 nears the leading edge of the wheel cutter 80, the batting 8 is compressed to a thickness less than the radius of the wheel cutter.

The batting 8 being compressed to a thickness less than the radius of the wheel cutter 80, the wheel cutter can readily sever the batting as it lays between the wheel cutter and the support surface 22. The wheel cutter 80 can thus follow a straight or curvilinear cut path.

As necessary, the cutting assembly may be selectively raised from the cut position adjacent support surface 22 to the load position above the level of the uncompressed batting 8 and moved to another section of the batting. Alternatively, the cutter assembly 60 may be selectively re-engaged with the batting 8 to allow intersecting cut paths.

It has been found that relatively large wheel cutters, those having a radius substantially equal to the uncompressed thickness of the batting may be employed to cut the batting. These relatively large wheel cutters are often capable of cutting the batting without requiring a compressor guide. However, these wheel cutters (having a diameter of 4 inches or more) are extremely expensive compared to the smaller wheel cutters and thus add to the cost of the system. Therefore, it has been found advantageous to employ the commercially available 2 to 2.5 inch wheel cutters in conjunction with the compressor guide to cut the batting.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. In combination, a compressible material and a cutting assembly for severing the compressible material disposed on a support surface, said cutting assembly comprising:

(a) a wheel cutter translatable in cutting engagement with the support surface along a first direction and a transverse second direction, the wheel cutter having a diameter less than an initial thickness of the compressible material; and (b) a compressor guide adjacent the wheel cutter and translatable with the wheel cutter, the compressor guide having a leading face spaced from the support surface by at least the initial thickness, and a compressing face adjacent the wheel cutter and having a nadir spaced from the support surface by less than the wheel cutter diameter wherein the nadir defines the compressed thickness.

2. The combination of claim 1 wherein the compressor guide further comprises a compressor wheel wherein the leading face and compressing face are positioned on the compressor wheel.

3. The combination of claim 2, further comprising a second compressor wheel having a leading face and a compressor face, a portion of the wheel cutter being located between the compressor wheels.

4. The combination of claim 3, wherein the compressor wheel and the second compressor wheel are concentric.

5. The combination of claim 1 further comprising a float mechanism connected to the compressor guide for allowing resilient displacement of the compressor guide relative to the support surface.

* * * * *